United States Patent [19]

Omachi

[11] Patent Number: 4,599,983

[45] Date of Patent: Jul. 15, 1986

[54] METHOD AND APPARATUS FOR INJECTING FUEL FOR A DIESEL ENGINE

[75] Inventor: Yoshio Omachi, Hiratsuka, Japan

[73] Assignee: Kabushiki Kaisha Komatsu Seisakusho, Tokyo, Japan

[21] Appl. No.: 424,751

[22] Filed: Sep. 27, 1982

[30] Foreign Application Priority Data

Nov. 9, 1981 [JP] Japan ..... 56-166763
Nov. 9, 1981 [JP] Japan ..... 56-179252
Nov. 9, 1981 [JP] Japan ..... 56-179253

[51] Int. Cl.[4] ..... F02M 39/00

[52] U.S. Cl. ..... 123/497; 123/509; 239/87; 417/380

[58] Field of Search ..... 123/497, 499, 507, 508, 123/509; 417/380, 245; 239/87, 585

[56] References Cited

U.S. PATENT DOCUMENTS 1,919,286 7/1933 Woolson ..... 123/508
2,703,562 3/1955 Seubert ..... 239/87
2,917,034 12/1959 Bessiere ..... 239/87
3,152,584 10/1964 Petroff ..... 123/508
4,427,151 11/1984 Trenne ..... 239/87

FOREIGN PATENT DOCUMENTS 0527395 4/1954 Belgium ..... 417/380

*Primary Examiner*—Carl Stuart Miller

*Attorney, Agent, or Firm*—Spensley Horn Jubas & Lubitz

[57] ABSTRACT

Improved method and apparatus for injecting fuel for a diesel engine are disclosed which are constructed such that a push rod is disposed in a nozzle body and fuel is injected into a combustion chamber by actuating the push rod. The improvement of the invention consists in that push rod actuating force is accumulated for a certain period of time while the push rod is stationarily held by means of an electromagnetic coil which is energized. Fuel injection is thus carried out by releasing the accumulated force by way of deenergization of the electro-magnetic coil. In an embodiment of the invention push rod actuating force is extracted from a cam driving mechanism and a coil spring disposed between the cam driving mechanism and the push rod serves as a push rod actuating force accumulating means. In a modified embodiment of the invention push rod actuating force is extracted from a combination of an auxiliary piston and a rocker arm and an auxiliary cylinder serves as a push rod actuating force accumulating means. Preferably, an auxiliary electromagnetic coil is disposed on the nozzle body so as to assist in actuation of the push rod. In another modified embodiment of the invention similar to the preceding one a hydraulic system is provided between the auxiliary piston and the push rod as a push rod actuating force accumulating means.

8 Claims, 4 Drawing Figures

METHOD AND APPARATUS FOR INJECTING FUEL FOR A DIESEL ENGINE

BACKGROUND OF THE INVENTION

1. Field of the Invention

The present invention relates to method and apparatus for injecting fuel for a diesel engine and more particularly to method and apparatus for a diesel engine which are constructed such that a push rod is disposed in a nozzle body and fuel is injected into a combustion chamber by actuating the push rod.

2. Description of the Prior Art

A hitherto known fuel injection apparatus of the above kind for a diesel engine is generally constructed such that fuel injection is carried out by means of a push rod actuating force extracting mechanism essentially comprising a cam, an actuating rod and a rocker arm by way of the steps of rotating a cam shaft extending in parallel to a crankshaft in synchronization with the latter, vertically displacing the actuating rod by means of the cam, turning the rocker arm by means of the actuating rod and then depressing a push rod to forcibly inject fuel held in a suck hole into a combustion chamber.

However, due to the arrangement that the push rod is directly actuated by means of the rocker arm it has been pointed out as drawbacks with respect to the conventional fuel injection apparatus that strictly controlled injection timing is required and moreover it is substantially impossible to control injection timing correctly in dependence on number of rotations of the engine and others.

SUMMARY OF THE INVENTION

Thus, the present invention is intended to obviate the drawbacks inherent to the conventional fuel injection apparatus as described above. Specifically, the present invention consists in that push rod actuating force is accumulated for a certain period of time using a resilient means in the form of a coil spring or compressive fluid while the push rod is stationarily held by means of an electromagnetic coil which is excited and fuel injection is then carried out by releasing the accumulated push rod actuating force by way of demagnetization of the electromagnetic coil.

Basically, a method of injecting fuel for a diesel engine in accordance with the present invention is practiced by way of the steps of extracting push rod actuating force from an engine driving system, accumulating the push rod actuating force for a certain period of time, releasing the accumulated force at a predetermined time and actuating the push rod in a nozzle body with the accumulated force to inject fuel into a combustion chamber.

In a preferred embodiment of the invention an apparatus for practicing the method of the invention comprises a push rod actuating force extracting system, a coil spring serving as a push rod actuating force accumulating means and an electromagnetic coil adapted to release the accumulated push rod actuating force by way of demagnetization which is effected at a predetermined time. The push rod actuating force extracting system is constituted by a conventional cam driving mechanism including a cam, an actuating rod and a rocker arm. The coil spring is disposed between the one free end of the rocker arm and the upper end part of the push rod so as to accumulate the push rod actuating force. The electromagnetic coil is in operative association with the push rod so as to open the latter during its magnetization. The upper part of the push rod serves as a magnetic core so that is is raised up when the electromagnetic coil is excited.

In a modified embodiment of the invention the push rod actuating force extracting system is constituted by a combination of an auxiliary piston slidably fitted in an auxiliary cylinder exposed to the combustion chamber, a piston rod and a rocker arm. In this embodiment a combination of the auxiliary piston and the auxiliary cylinder serves as a push rod actuating force accumulating means.

Preferably, a resilient means in the form of a coil spring is disposed between a flange portion of the push rod and the upper part of the nozzle body or it is fitted to the rocker arm so that the push rod is restored to the original position after completion of fuel injection.

An auxiliary electromagnetic coil is preferably disposed in operative association with the push rod so that the latter is additionally actuated in such a direction as to inject fuel into the combustion chamber when the auxiliary electromagnetic coil is excited.

In another modified embodiment of the invention the push rod actuating force accumulating means is constituted by a hydraulic system extending between the auxiliary piston in the auxiliary cylinder and the upper portion of the push rod. The latter is constructed in the form of a piston. A pressure chamber including the auxiliary piston and another pressure chamber including the piston are in communication with one another via a hydraulic passage. The electromagnetic coil is in operative association with the push rod piston so as to hold the push rod during its magnetization. When the electromagnetic coil is demagnetized, the push rod is actuated by means of the piston so as to inject fuel into the combustion chamber.

Also in this embodiment an auxiliary electromagnetic coil is preferably disposed in operative association with the push rod so that the latter is additionally actuated in such a direction as to inject fuel when it is excited.

A differential valve is disposed midway of a fuel passage extending between the push rod and the injection hole. The differential valve is normally closed by means of a coil spring. It is opened by fuel pressure when the push rod is actuated and closed immediately after completion of fuel injection.

It is an object of the present invention to provide method and apparatus which ensure that correct fuel injection is carried out in the optimum timing relation irrespective of any number of rotations of the engine.

It is other object of the present invention to provide method and apparatus which ensure that fuel injection timing is correctly controlled.

It is another object of the present invention to provide method and apparatus which ensure that fuel injection is reliably carried out without any advance or delay from the correct injection timing.

It is further another object of the present invention to provide method and apparatus which are simple in structure and can be practiced at an inexpensive cost.

Other objects and advantageous features of the invention will be readily understood from the reading of the following description made in conjunction with the accompanying drawings.

DESCRIPTION OF THE DRAWINGS

The accompanying drawings will be briefly described hereunder.

DETAILED DESCRIPTION OF THE PREFERRED EMBODIMENTS

Now the present invention will be described in a greater detail hereunder with reference to the accompanying drawings which illustrate preferred embodiments of the invention.

Figure 1:
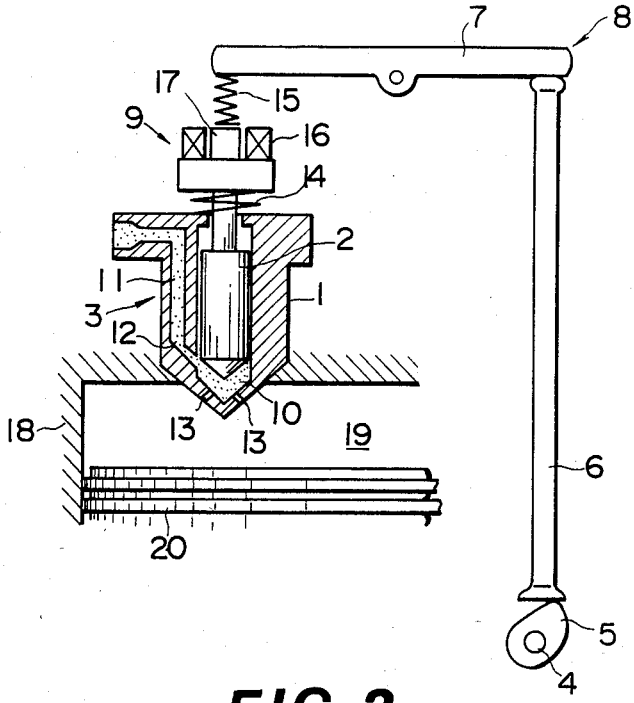
FIG. 1 is a vertical sectional view schematically illustrating a fuel injection apparatus for a diesel engine in accordance with a preferred embodiment of the invention.

First, FIG. 1 schematically illustrates a preferred embodiment of the invention. In this embodiment a fuel injection apparatus for a diesel engine essentially comprises an open type injection nozzle 3 with a push rod or plunger 2 incorporated in a nozzle body 1, an actuating force extracting mechanism 8 including a cam 5 fixedly fitted onto a cam shaft 4 adapted to be rotated by a crankshaft (not shown) in synchronization with the latter, said cam shaft 4 extending in parallel to the crankshaft, an actuating rod 6 adapted to be vertically displaced by means of the cam 5 and a rocker arm 7 pivotally driven by means of the actuating rod 6 so as to extract actuating force from the cam shaft 4 for actuating the push rod 2, and a push rod actuating timing determining means 9. Specifically, the open type injection nozzle 3 includes a suck hole 10 located at the lower end part of the nozzle body 1, a fuel passage 11 in communication with said suck hole 10 by way of a metering orifice 12 and an injection hole 13 drilled through the wall surrounding the suck hole 10. Further, the open type injection nozzle 3 includes a coil spring 14 disposed between the nozzle body 1 and a flange portion of the push rod 2 so as to normally urge the latter in the upward direction.

The push rod actuating timing determining means 9 comprises a compressive coil spring 15 disposed between the one free end of the rocker arm 7 and the top end of the push rod 2, an electromagnetic coil 16 fixedly mounted on the flange portion of the push rod 2 and a magnetic core 17 capped on the top end part of the push rod 2, said magnetic core 17 being projected above from the flange portion of the push rod 2. When the electromagnetic coil 16 is energized, the magnetic core 17 is displaced upward so that push rod 2 is kept open. In FIG. 1 reference numeral 18 designates a cylinder, reference numeral 19 does a combustion chamber and reference numeral 20 does a piston.

Next, operation of the fuel injection apparatus for a diesel engine in accordance with the above-described embodiment of the invention will be described below.

During upward stroke of the piston 20 the push rod 2 is energized in the upward direction by means of the coil spring 14 and the electromagnetic coil 16 is excited at a predetermined time. As the piston 20 continues its upward movement, the actuating rod 6 is raised up by means of the cam 5 and the rocker arm 7 is in turn rotated in the anticlockwise direction by means of the actuating rod 6. Thus, the coil spring 15 is increasingly compressed by means of the rocker arm 7 during the anticlockwise rotation of the latter. Since the electromagnetic coil 16 is excited during the compressive movement of the coil spring 15, the push rod 2 is kept in firm contact with the electromagnetic coil 16 whereby the coil spring 15 continues to be compressed. While the piston 20 continues its upward movement until it reaches a position in the proximity of the upper dead point, fuel delivered from a fuel feed pump (not shown) flows into the suck hole 10 via the fuel passage 11 and the metering orifice 12 so that it is stored therein. Next, when the piston 20 reaches the upper dead end point or a position in the proximity thereto, the electromagnetic coil 16 is demagnetized so as to release the push rod 2 from the strained state. Thus, the push rod 2 is depressed by expansive force of the coil spring 15 and thereby fuel stored in the suck hole 10 is injected into the combustion chamber 19 through the injection hole 13. As injected fuel is burnt in the combustion chamber 19, the piston 20 moves downward and the push rod 2 is restored upward by expansive force of the coil spring 14. This causes the rocker arm 7 to be rotated in the clockwise direction by way of the coil spring 15. Subsequently, the actuating rod 6 is displaced downward. When it is displaced to the lowermost position, its lower end comes in contact with the peripheral surface of the cam 5 where the latter has the shortest radial distance from the center axis of the cam shaft 4.

In the illustrated embodiment and coil spring 14 is disposed between the upper surface of the nozzle body 1 and the flange portion of the push rod 2 so that the latter is restored upward by expansive force of the coil spring 14, as described above. Alternatively, the push rod 2 may be restored by exciting the electromagnetic coil 16. In this case the coil spring 14 is not required.

Figure 2:
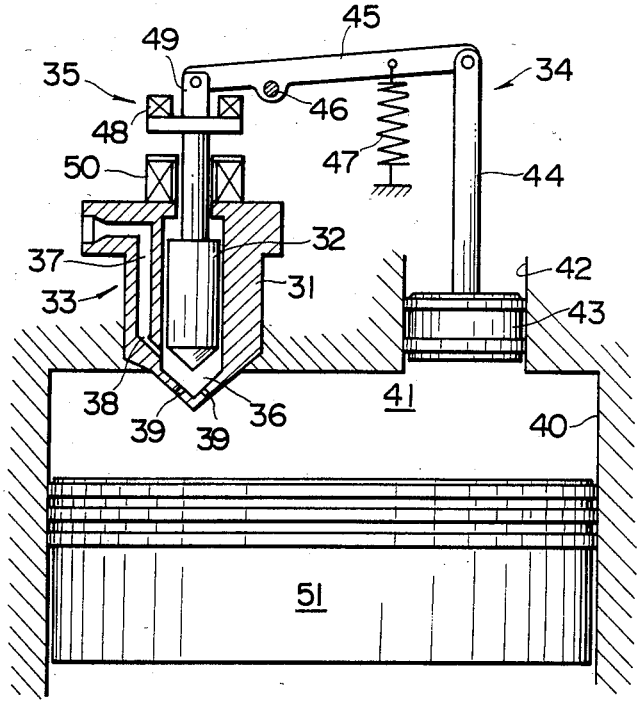
FIG. 2 is a vertical sectional view similar to FIG. 1, schematically illustrating a fuel injection apparatus for a diesel engine in accordance with a modified embodiment of the invention.

Next, FIG. 2 schematically illustrates a fuel injection apparatus for a diesel engine in accordance with a modified embodiment of the invention. In this embodiment the fuel injection apparatus essentially comprises an open type injection nozzle 33 with a push rod or plunger 32 incorporated in a nozzle body 31, an actuating force extracting mechanism 34 for actuating the push rod 32 in the nozzle body 31 and a push rod actuating timing determining means 35 for transmitting actuating force to the push rod 32 in a specific timing relation. The open type injection nozzle 33 includes a suck hole 36 at the lower end part of the nozzle body 31, a fuel passage 37 extending along the side wall of the nozzle body 31, said fuel passage 37 being in communication with said suck hole 36 via a metering orifice, and an injection hole 39 formed on the wall surrounding the suck hall 36. The actuating force extracting mechanism 34 includes an auxiliary cylinder 42 opened toward a combustion chamber 41 of a main cylinder 40, an auxiliary piston 43 slidably fitted into said auxiliary cylinder 42 and a rocker arm 45 in operative connection with said auxiliary piston 43 via a rod 44. Further, the rocker arm 45 is in operative connection with a push rod 32 which is located opposite to the piston rod 44 relative to a pivotal shaft 46 and it is normally urged to turn in the clockwise direction under resilient force caused by means of coil spring 47. The push rod actuating timing determining means 35 includes an electromagnetic coil 48 disposed at the upper part of the push rod 32 and a magnetic core 49 capped on the top end part of the push rod 32 so that the push rod 32 is kept open by exciting the electromagnetic coil 48 and thereby displacing the magnetic core 49 upward. In this embodiment an auxiliary electromagnetic coil 50 adapted to be operated in the reverse manner relative to the electromagnetic coil 48 is disposed below the latter in a spaced relation. In the drawing reference numeral 51 designates a main piston.

Next, operation of the fuel injection apparatus for a diesel engine in accordance with the above-described embodiment of the invention will be described below.

During upward stroke of the main piston 51 the electromagnetic coil 48 is energized, whereas the auxiliary electromagnetic coil 50 is deenergized. Thus, the push rod 32 is kept open under attractive force caused by means of the electromagnetic coil 48 whereby the auxiliary piston 43 in operative connection with the push rod 32 via the rocker arm 45 and the piston rod 44 stands still against increased pressure in the combustion chamber 41. While the main piston 51 continues its upward movement and reaches a position in the proximity of the upper dead point, fuel delivered from a fuel feed pump (not shown) flows into the suck hole 36 via the fuel passage 37 and the metering orifice 38 so that it is stored in the suck hole 36. When the piston 51 reaches the upper dead end or a position in the proximity thereto, the electromagnetic coil 48 is deenergized and at the same time the auxiliary electromagnetic coil 50 is energized. Thus, the push rod 32 is released from the restrained state so that the auxiliary piston 43 is displaced upward under increased pressure in the combustion chamber 41, causing the piston rod 44 to be displaced upward. As a result the rocker arm 45 is turned in the anticlockwise direction as seen in the drawing and the push rid 32 is then depressed instantaneously by means of the rocker arm 45 so that fuel stored in the suck hole 36 is forcibly injected into the combustion chamber 41 through the injection hole 39. During fuel injection the auxiliary electromagnetic coil 50 assists in downward displacement of the push rod 32 caused by increased pressure in the combustion chamber 41 and the aforesaid fuel injection is maintained for a predetermined period of time with the push rod 32 depressed until the injection hole 39 is fully closed. When fuel injected into the combustion chamber 41 in that way is burnt completly therein, the main piston 51 is caused to move downward. When the auxiliary electromagnetic coil 50 is deenergized, the push rod 32 is restored to the original position (valve opened state) together with the auxiliary piston 43, the piston rod 44 and the rocker arm 45 under resilient force of the coil spring 47 and negative pressure in the combustion chamber 41 caused by the downward displacement of the main piston 51.

Figure 3:
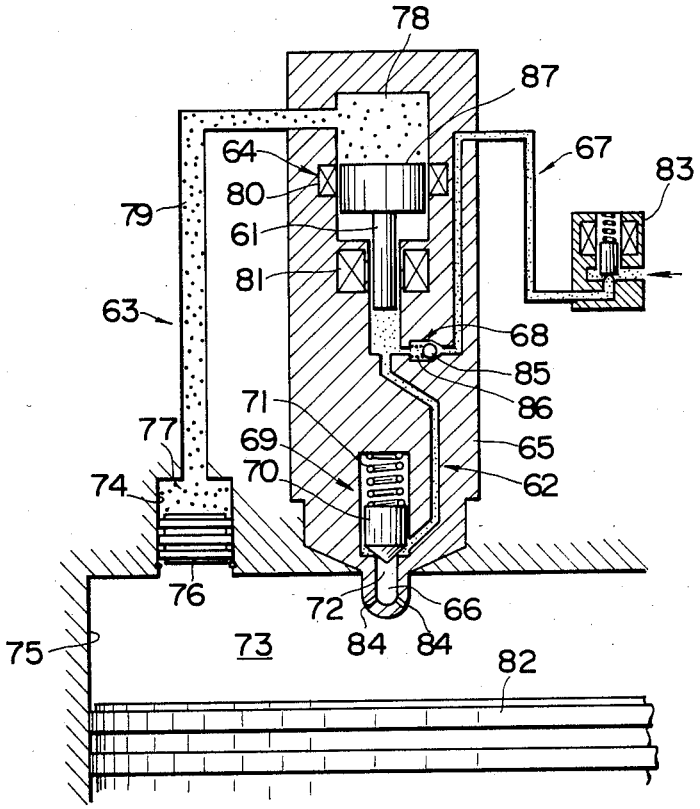
FIG. 3 is a vertical sectional view similar to FIG. 2, schematically illustrating a fuel injection apparatus for a diesel engine in accordance with another modified embodiment of the invention.

Next, FIG. 3 schematically illustrates a fuel injection apparatus for a diesel engine in accordance with another modified embodiment of the invention. In this embodiment the fuel injection apparatus essentially comprises a fuel holding section 62 with a push rod or plunger 61 incorporated therein, an actuating force extracting mechanism 63 for actuating the push rod 61 and a push rod actuating timing determining means 64 for transmitting actuating force to the push rod 61 in a specific timing relation. The fuel holding section 62 is defined between a check valve 68 in a fuel feed system 67 and a suck hole 66 in a nozzle body 65, said fuel feed system 67 extending from a fuel feed pump (not shown) to said suck hole 66 in the nozzle body 65. The lower end part of the push rod 61 is exposed to the fuel holding section 62. Further, the fuel holding section 62 is equipped with a differential valve 69 which is located above the suck hole 66, said differential valve 69 comprising a valve disc 70 which is adapted to be urged downward by means of a coil spring 71 so that a fuel delivery port 72 to the suck hole 66 is normally closed. The actuating force extracting mechanism 63 includes an auxiliary cylinder 74 formed at the upper part of a main cylinder 75, said auxiliary cylinder 74 being exposed to a combustion chamber 73, an auxiliary piston 76 slidably fitted in the auxiliary cylinder 74, a pressure chamber 77 in the auxiliary cylinder 74 defined above the auxiliary piston 76 and another pressure chamber 78 in the nozzle body 65 defined above the push rod 61, said pressure chamber 77 and said pressure chamber 78 being filled with working hydraulic oil 79 so that they are in hydraulic communication with one another. The push rod actuating timing determining means 64 includes an electromagnetic coil 80 disposed above the push rod 61 and a movable magnetic core which is constituted by the upper part of the push rod 61, said magnetic core being adapted to be displaced upward under attractive force caused by energizing the electromagnetic coil 80. Further, the push rod actuating timing determining means 64 includes an auxiliary electromagnetic coil 81 disposed below the push rod 61, said auxiliary electromagnetic coil 81 being adapted to be operated in the reverse manner relative to the electromagnetic coil 80. Specifically, the auxiliary electromagnetic coil 81 serves to assit in downward movement of the push rod 61 and hold the latter at the lowered position while it is energized. In the drawing reference numeral 82 designates a main piston, reference numeral 83 does a metering valve and reference numeral 84 does an injection hole.

Figure 4:
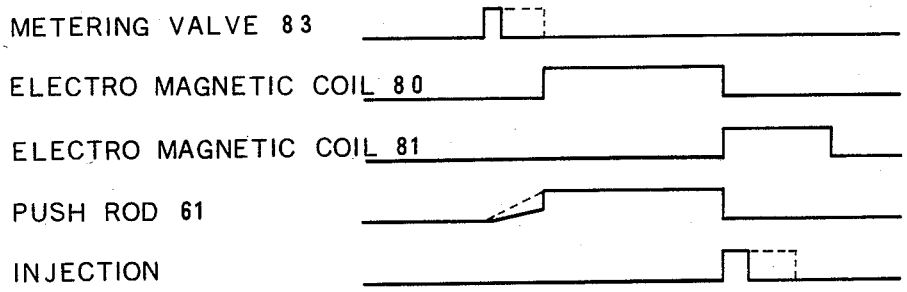
FIG. 4 is a timing chart representing functional characteristics of the fuel injection apparatus in FIG. 3.

Next, operation of the fuel injection apparatus for a diesel engine in accordance with the above-described embodiment of the invention will be described below with reference to FIG. 4 which is a typical time chart representing characteristic features of the apparatus. In addition the structure of the apparatus will be described in more details.

Fuel delivered from a fuel feed pump (not shown) flows into the fuel holding section 62 via the metering valve 83 and the check valve 68 at a certain time in the course of upward stroke of the main piston. While fuel flows into the fuel holding section 62, a rate of fuel feed is determined by means of the metering valve 83. After flowing through the metering valve 83, fuel enters the fuel holding section 62 by opening a ball 85 in the check valve 68 against resilient force of the coil spring 86 whereby the push rod 61 is raised up. When the push rod 61 reaches a position in the proximity of the upper dead point, the electromagnetic coil 80 is excited so that the push rod 61 is kept at the elevated position.

As the main piston 82 continues its upward movement to increase pressure in the combustion chamber 73, the auxiliary piston 76 is exposed to the increased pressure in the combustion chamber 73 which is in turn exerted on the upper surface 87 of the push rod 61 by way of the working hydraulic oil 79. However, the push rod 61 is held at the elevated position under magnetic force caused by means of the eletromagnetic coil 80. When the main piston 82 moves upward further and reaches the upper dead point or a position in the proximity thereof, the electromagnetic coil 80 is demagnetized and at the same time the auxiliary electromagnetic coil 81 is magnetized. Since the push rod 61 is released from the restrictive magnetic force, the push rod 61 is depressed by the increased pressure in the combustion chamber 73 transmitted to the upper surface 87 of the push rod 61 via the auxiliary piston 76 and the working hydraulic oil 79. Thus, fuel in the fuel holding section 62 is injected from the suck hole 66 into the combustion chamber 73 through the injection hole 84 by means of the push rod 61. It should be noted that during the fuel injection the check valve 68 serves to inhibit any backflow of fuel in the fuel holding section 62 into the metering valve 83.

After completion of fuel injection the valve disc 70 in the differential valve 69 closes the fuel delivery port 72 whereby leakage of residual fuel in the fuel holding section 62 is completely prevented, said leakage being caused by reduced pressure in the combustion chamber 73 during downward stroke of the main piston 82.

It should be of course understood that the present invention has been described above with respect to three preferred embodiments of the invention as illustrated in the accompanying drawings but it should be not limited only to them and various changes or modifications may be made within any departure from the spirit and scope of the invention.

What is claimed is:

1. An apparatus for injecting fuel into a combustion chamber for a diesel engine in which an intended fuel injection is carried out by way of the steps of extracting plunger actuating force from an engine driving system via a cam actuating mechanism, accumulating the plunger actuating force in a resilient means in the form of a spring for a certain period of time, releasing the accumulated force by way of deenergization of electromagnetic force and actuating the plunger in a stationary nozzle body affixed to the combustion chamber with the accumulated force to inject fuel into the combustion chamber via stationary injection holes, the apparatus comprising;

a plunger actuating force extracting system including a cam rotated by means of a cam shaft, a vertically extending actuating rod and a rocker arm in operative connection with the upper end of said actuating rod at the one free end thereof, a coil spring serving as a plunger actuating force accumulating means, said coil spring being disposed between the other free end of the rocker arm and the upper end part of the plunger, and an electromagnetic coil adapted to release the accumulated plunger actuating force by way of demagnetization which is effected at a predetermined time, said electromagnetic coil being in operative association with the plunger in the nozzle body so as to open the latter during magnetization which is effective in raising up the plunger of which upper part serves as a magnetic core.

2. An apparatus as defined in claim 1, wherein a resilient means in the form of a coil spring is disposed between a flange portion of the plunger and the upper end part of the nozzle body so that the plunger is restored to the original position after completion of fuel injection.

3. An apparatus for injecting fuel for a diesel engine in which an intended fuel injection is carried out by way of the steps of extracting push rod actuating force from a combustion chamber in a main cylinder, accumulating the push rod actuating force in a resilient means in the form of an auxiliary cylinder for a certain period of time, releasing the accumulated force by way of deenergization of electromagnetic force and actuating the push rod in a nozzle body with the accumulated force to inject fuel into the combustion chamber, the apparatus comprising in combination;

a push rod actuating force accumulating and extracting system including an auxiliary piston slidably fitted in the auxiliary cylinder, a piston rod, and a rocker arm in operative connection with both the free end of said piston rod and with said push rod, said nozzle body and said push rod being separated from the auxiliary piston and cylinder, and an electromagnetic coil adapted to release the accumulated push rod actuating force by way of demagnetization which is effected at a predetermined time, said electromagnetic coil being in operative association with the push rod in the nozzle body so as to open the latter during magnetization which is effective in raising up the push rod of which the upper part serves as a magnetic core.

4. An apparatus as defined in claim 3, wherein a resilient means in the form of a coil spring is fitted to the rocker arm so that the push rod is restored to the original position after completion of fuel injection.

5. An apparatus as defined in claim 3, wherein an auxiliary electromagnetic coil is disposed in operative association with the push rod so that the push rod is additionally actuated in such a direction as to inject fuel when said auxiliary electromagnetic coil is energized.

6. An apparatus for injecting fuel for a diesel engine in which an intended fuel injection is carried out by extracting push rod actuating force from a combustion chamber in a main cylinder, accumulating the push rod actuating force in a hydraulic system including an auxiliary cylinder and others for a certain period of time, releasing the accumulated force by way of deenergization of electromagnetic force and actuating the push rod in a nozzle body by means of a push rod piston adapted to be actuated by the accumulated force in the hydraulic system to inject fuel into the combustion chamber, the apparatus comprising in combination;

a push rod actuating force extracting means including an auxiliary piston slidably fitted in the auxiliary cylinder which is exposed to the combustion chamber, a push rod actuating force accumulating means comprising a hydraulic system extending from the auxiliary piston in the auxiliary cylinder to the upper portion of the push rod in the form of a piston by means of which the push rod is actuated by the accumulated hydraulic pressure in such a manner as to inject fuel along a fuel supply path and into the combustion chamber, said hydraulic system including a pressure chamber for the auxiliary piston and another pressure chamber for the push rod actuating piston both of which are in communication with one another by way of a hydraulic passage, a valve located in the fuel supply path so as to normally prevent passage of fuel into the combustion chamber, the valve being opened by the fluid pressure of the fuel in the fuel supply path when the push rod is actuated, and an electromagnetic coil adapted to release the accumulated push rod actuating force, thereby forcing fuel past the valve and into the combustion chamber, by way of demagnetization which is effected at a predetermined time, said electromagnetic coil being in operative association with the push rod actuating piston in said pressure chamber in the nozzle body so as to hold the push rod during magnetization which is effective in raising up the push rod of which the upper part serves both as a magnetic core and a piston.

7. An apparatus as defined in claim 6, wherein an auxiliary electromagnetic coil is disposed in operative association with the push rod so that the push rod is additionally actuated in sich a direction as to inject fuel when said auxiliary electromagnetic coil is energized.

8. An apparatus as defined in claim 6, wherein a differential valve is disposed midway of a fuel passage extending from the push rod to the injection hole which is adapted to be normally closed by means of a resilient means in the form of a coil spring, said differential valve being opened by fuel pressure when the push rod is actuated and closed immediately after completion of fuel injection.

* * * * *